US010687153B2

(12) United States Patent
Albahri et al.

(10) Patent No.: US 10,687,153 B2
(45) **Date of Patent: *Jun. 16, 2020**

(54) HEARING DEVICE WITH CONTEXTUALLY ACTUATED VALVE

(71) Applicant: Knowles Electronics, LLC, Itasca, IL (US)

(72) Inventors: Shehab Albahri, Hanover Park, IL (US); Christopher Monti, Elgin, IL (US); Thomas Miller, Arlington Heights, IL (US); Charles King, Oak Park, IL (US); Christopher Jones, Carpentersville, IL (US); Brenno Varanda, Hoffman Estates, IL (US); Erik Wiederholtz, St. Charles, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/236,560

(22) Filed: Dec. 30, 2018

(65) Prior Publication Data

US 2019/0215621 A1 Jul. 11, 2019

Related U.S. Application Data

(60) Provisional application No. 62/614,929, filed on Jan. 8, 2018.

(51) Int. Cl.
*H04R 25/00* (2006.01)
*H04R 1/10* (2006.01)

(52) U.S. Cl.
CPC ..... *H04R 25/505* (2013.01); *H04R 1/1083* (2013.01); *H04R 25/405* (2013.01); *H04R 25/407* (2013.01); *H04R 25/604* (2013.01); *H04R 25/65* (2013.01); *H04R 1/1041* (2013.01); *H04R 25/554* (2013.01); *H04R 25/558* (2013.01); *H04R 2225/025* (2013.01); *H04R 2225/41* (2013.01); *H04R 2420/07* (2013.01)

(58) Field of Classification Search
CPC .. H04R 25/505; H04R 25/554; H04R 25/604; H04R 25/65; H04R 2225/025
USPC ..... 381/312
See application file for complete search history.

(56) References Cited

U.S. PATENT DOCUMENTS 4,133,984 A 1/1979 Akiyama
4,605,197 A 8/1986 Casey
(Continued)

*Primary Examiner* — Phylesha Dabney
(74) *Attorney, Agent, or Firm* — Faegre Drinker Biddle & Reath LLP

(57) ABSTRACT

The present disclosure pertains to hearing devices configurable between open fit and closed fit configurations at different times through actuation of one or more acoustic valves located in one or more corresponding sound passages of the hearing device. The one or more acoustic valves of the hearing device are adaptively controlled based on context detected by one or more sensors. The context may be, but is not limited to, a mode of operation of the hearing devices which may include, for example, an audio content playback mode and a voice communication mode. The actuatable valves may be actuatable in situ without having to remove the hearing device from the user's ear thereby enabling the user to experience the benefit of a closed fit or an open fit depending on the user's desire or other context.

22 Claims, 8 Drawing Sheets

(56) References Cited

U.S. PATENT DOCUMENTS

| | | | | |
|---|---|---|---|---|
| 5,033,090 | A * | 7/1991 | Weinrich | H04R 25/453 381/318 |
| 6,068,079 | A * | 5/2000 | Hamery | A61F 11/08 128/864 |
| 7,478,702 | B2 | 1/2009 | Berg | |
| 8,199,955 | B2 | 6/2012 | Akino | |
| 9,525,929 | B2 | 12/2016 | Burgett | |
| 2010/0111340 | A1 | 5/2010 | Miller et al. | |
| 2011/0182453 | A1 | 7/2011 | Van Hal | |
| 2014/0169579 | A1 | 6/2014 | Azmi | |
| 2014/0169603 | A1* | 6/2014 | Sacha | H04R 25/60 381/324 |
| 2018/0091892 | A1* | 3/2018 | Taylor | H04R 1/2826 |
| 2019/0116436 | A1* | 4/2019 | Lawand | H04R 1/1016 |
| 2019/0208301 | A1* | 7/2019 | Monti | H04R 1/1016 |
| 2019/0208343 | A1* | 7/2019 | Monti | H04R 25/456 |

* cited by examiner

HEARING DEVICE WITH CONTEXTUALLY ACTUATED VALVE

RELATED APPLICATIONS

This application relates to U.S. Provisional Patent Application Ser. No. 62/614,929 filed on Jan. 8, 2018, and entitled "Audio Device with Acoustic Valve," the entire contents of which is hereby incorporated by reference.

TECHNICAL FIELD

This disclosure relates generally to audio devices and, more specifically, to audio devices having an acoustic valve adaptively actuated based on context.

BACKGROUND

Audio devices are known generally and include hearing aids, earphones and ear pods, among other devices. Some audio devices are configured to provide an acoustic seal (i.e., a "closed fit") with the user's ear. The seal may cause a sense of pressure build-up in the user's ear, known as occlusion, a blocking of externally produced sounds that the user may wish to hear, and a distorted perception of the user's own voice among other negative effects. However, closed-fit devices have desirable effects including higher output at low frequencies and the blocking of unwanted sound from the ambient environment.

Other audio devices provide a vented coupling (i.e., "open fit") with the user's ear. Such a vent allows ambient sound to pass into the user's ear. Open-fit devices tend to reduce the negative effects of occlusion but in some circumstances may not provide optimized frequency performance and sound quality. One such open-fit hearing device is a receiver-in-canal (RIC) device fitted with an open-fit ear dome. RIC devices typically supplement environmental sound with amplified sound in a specific range of frequencies to compensate for hearing loss and aid in communication. The inventors have recognized a need for hearing devices that can provide the benefits of both open fit and closed fit.

BRIEF DESCRIPTION OF THE DRAWINGS

The objects, features and advantages of the present disclosure will become more fully apparent to those of ordinary skill in the art upon careful consideration of the following Detailed Description and the appended claims in conjunction with the drawings described below.

Figure 1:
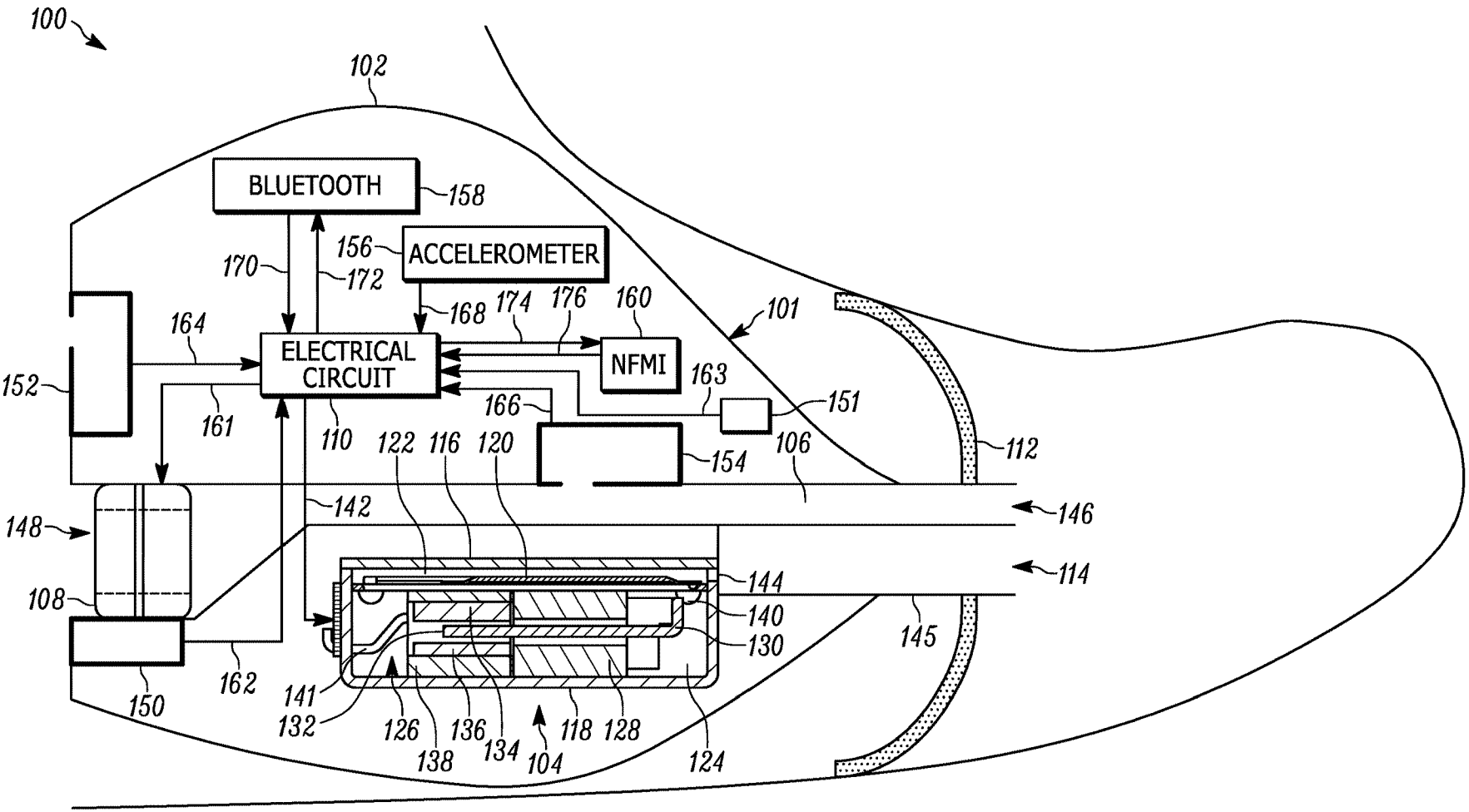
FIG. 1 is a schematic diagram illustrating a hearing device partially inside the user's ear canal.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. The terms and expressions used herein have the ordinary technical meaning as is accorded to such terms and expressions by persons skilled in the technical field as set forth above except where different specific meanings have otherwise been set forth herein.

DETAILED DESCRIPTION

The present disclosure pertains to hearing devices configurable between open fit and closed fit configurations at different times through actuation of one or more acoustic valves located in one or more corresponding sound passages of the hearing device. The one or more acoustic valves of the hearing device are adaptively controlled based on context detected by one or more sensors. The context may be, but is not limited to, a mode of operation of the hearing devices which may include, for example, an audio content playback mode and a voice communication mode. The actuatable valves may be actuatable in situ without having to remove the hearing device from the user's ear thereby enabling the user to experience the benefit of a closed fit or an open fit depending on the user's desire or other context.

The teachings of the present disclosure are generally applicable to hearing devices including a sound-producing electroacoustic transducer disposed in a housing having a portion configured to form a seal with the user's ear. The seal may be formed by an ear tip or other portion of the hearing device. In some embodiments, the hearing device is a receiver-in-canal (RIC) device for use in combination with a behind-the-ear (BTE) device including a battery and an electrical circuit coupled to the RIC device by a wired connection that extends about the user's ear. The RIC typically includes a sound-producing electro-acoustic transducer disposed in a housing having a portion to be inserted at least partially into a user's ear canal. In other embodiments, the hearing device is an in-the-ear (ITE) device or a completely-in-canal (CIC) device containing the transducer, electrical circuits and all other components. In another embodiment, the hearing device is a behind-the-ear (BTE) device containing the transducer, electrical circuits and other active components with a sound tube and other passive components that extends into the user's ear. The teachings of the present disclosure are also applicable to over-the-ear devices, earphones, ear buds, and ear pods, in-ear headphones with wireless connectivity, and noise-cancelling earphones among other wearable devices that form at least a partially sealed coupling with the user's ear and emit sound thereto. These and other applicable hearing devices typically include a sound-producing electro-acoustic transducer operable to produce sound although the teachings are also applicable to hearing devices devoid of a sound-producing electro-acoustic transducer, like ear plugs.

In embodiments that include a sound-producing electro-acoustic transducer, the transducer generally includes a diaphragm that separates a volume within a housing of the hearing device into a front volume and a back volume. A motor actuates the diaphragm in response to an excitation signal applied to the motor. Actuation of the diaphragm moves air from a volume of the housing and into the user's ear via a sound opening of the hearing device. Such a transducer may be embodied as a balanced armature receiver or as a dynamic speaker among other known and future transducers. A hearing device may also include a plurality of sound-producing transducers of various types.

In one implementation, the hearing device includes an acoustic passage extending between a portion of the hearing device that is intended to be coupled to the user's ear (e.g., disposed at least partially in the ear canal) and a portion of the hearing device that is exposed to the environment. In this example, actuation of an acoustic valve disposed in or along the acoustic vent alters the passage of sound through the vent thereby configuring the hearing device between a relatively open fit state and a relatively closed fit state. When the acoustic valve is open, the pressure within the ear equalizes with the ambient air pressure outside the ear canal and at least partially allows the passage of low-frequency sound thereby reducing the occlusion effects that are common when the ear canal is fully blocked. Opening the acoustic valve also allows ambient sound outside the ear canal to travel through the acoustic passage and into the ear canal. Conversely, closing the acoustic valve creates a more complete acoustic seal with the user's ear canal which may be preferable for certain activities, such as listening to music. In another implementation, the acoustic passage does not extend fully through the housing between the user's ear and the ambient atmosphere. For example, the passage may vent a volume of the transducer to the ambient atmosphere to change an acoustic response of the hearing device.

Figure 3:
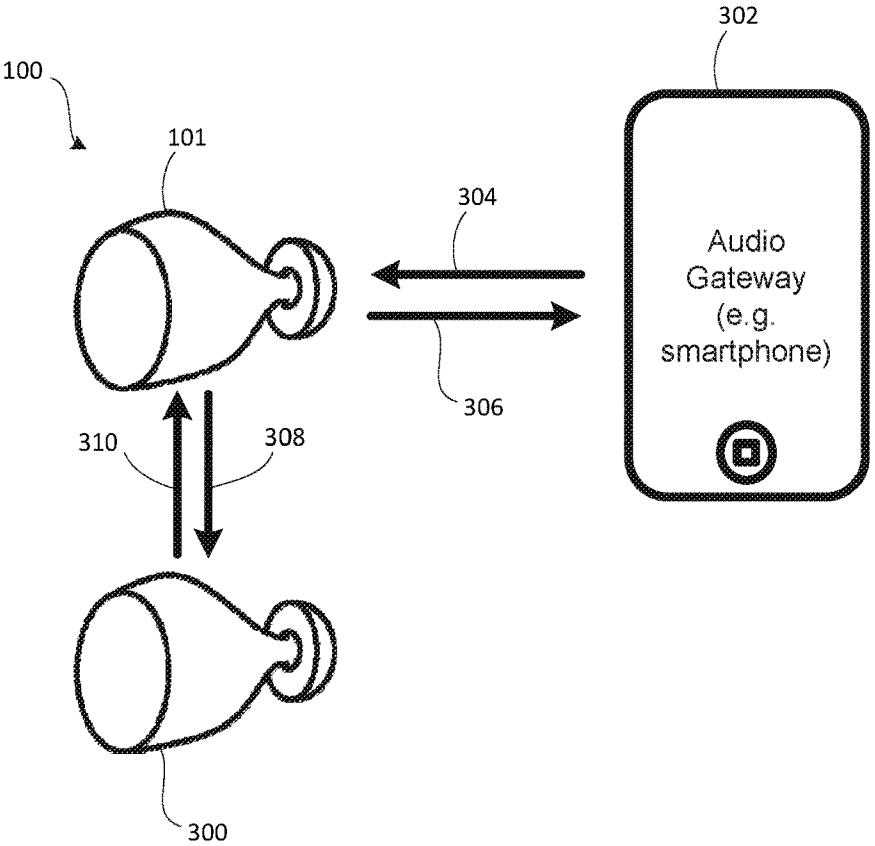
FIG. 3 is a schematic diagram illustrating the interactions between an audio gateway device and a pair of hearables of a hearing device.
Figure 2:
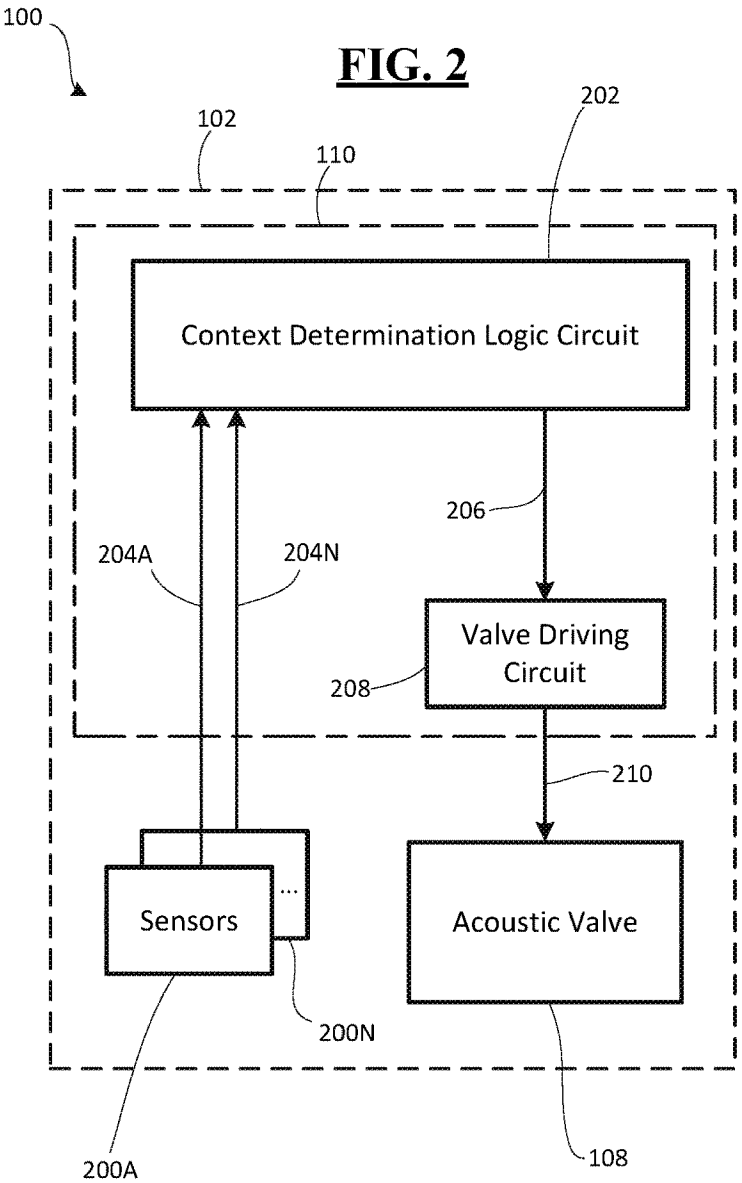
FIG. 2 is a block diagram illustrating a hearing device having sensors and context determination logic both located in the hearing device.

Each of FIGS. 1 to 3 illustrates a hearing device 100 as disclosed herein. FIG. 1 shows the hearing device 100 comprising a single hearable component that may be used alone or in combination with a second hearable component shown in FIGS. 3 and 4. In FIG. 1, the hearing device includes a housing 102 for the first hearable 101, a sound-producing electro-acoustic transducer 104, an acoustic passage 106, an acoustic valve 108 disposed along the acoustic passage 106, and an electrical circuit 110 configured to adaptively actuate the acoustic valve 108 as described herein. The second hearable component is configured similarly although the second hearable component may include fewer electrical circuits and functionality in embodiments where the first component is a master device and the second component is a slave device.

In FIG. 1, the housing 102 has a contact portion 112 that contacts the user's ear, for example a portion of the ear canal, when the hearing device 100 is in use. The contact portion 112 can be replaceable foam, a rubber ear tip, a custom molded plastic, or any other suitable ear dome which can be employed for the device. The housing 102 also defines a sound opening 114 through which sound travels from the electro-acoustic transducer 104 into the user's ear. The electro-acoustic transducer 104 is disposed in the housing 102 and includes a diaphragm 120 which separates the inside volume of the housing into a front volume and a back volume. In FIG. 1, the transducer is embodied as a balanced armature receiver including a transducer housing defined by a cover 116 and a cup 118 wherein the front volume is partially defined by the cover and the diaphragm and the back volume is defined by the cup. More generally, however, the housing 102 may form a portion, or all, of the transducer housing. The cover 116 and the diaphragm 120 partially define the front volume 122. In other embodiments, other sound-producing electroacoustic acoustic transducers may be employed including but not limited to dynamic speakers.

In FIG. 1, the electro-acoustic transducer 104 includes a motor 126 disposed in the back volume 124. The motor 126 includes a coil 128 disposed about a portion of an armature 130. A movable portion 132 of the armature 130 is disposed in equipoise between magnets 134 and 136. The magnets 134 and 136 are retained by a yoke 138. The diaphragm 120 is movably coupled to a support structure 140, and wires 141 extending through the cup 118 of the electro-acoustic transducer 104 transmit an electrical excitation signal 142. Application of the electrical excitation signal 142 to the coil 128 modulates the magnetic field, causing deflection of the armature 130 between the magnets 134 and 136. The deflecting armature 130 is linked to the diaphragm 120, wherein movement of the diaphragm 120 forces air through a sound port 144, which is defined by the cover 116 and the cup 118 of the electro-acoustic transducer 104. Movement of the diaphragm 120 results in changes in air pressure in the front volume 122 wherein acoustic pressure (e.g., sound) is emitted through the sound port 144. Armature receivers suitable for the embodiments described herein are available from Knowles Electronics, LLC. Dynamic speakers also include a motor disposed in a back volume, the operation of which is known generally to those of ordinary skill in the art.

The housing 102 includes the sound opening 114 located in a nozzle 145 of the housing 102. The sound opening 114 acoustically couples to the front volume 122, and sound produced by the acoustic transducer emanates from the sound port 144 of the front volume 122, through the sound opening 114 of the housing 102 and into the user's ear. The nozzle 145 also defines a portion of the acoustic passage 106 which extends through the hearing device 100 from a first port 146 defined by the nozzle 145 and acoustically coupled to the user's ear, and a second port 148 located in the acoustic valve 108 which acoustically couples to the ambient atmosphere. In another example, the volume of the electro-acoustic transducer can partially define the acoustic passage, although other suitable configurations may also be employed.

FIG. 1 illustrates various alternative sensors, wherein the electrical circuit 110 is coupled to a first proximity sensor 150, a second proximity sensor 151, a first microphone 152, a second microphone 154, and an accelerometer 156. In some embodiments, only one of the sensors shown is required to sense context. In other embodiments, the context is sensed by a sensor at a remote device like a smartphone and the hearing device is devoid of a sensor. And in still other embodiments, context is sensed by both sensors at the remote device and at the hearing device. Also, some of the sensors shown in FIG. 1 may be used for purposes other than context awareness. For example, multiple microphones may be used for acoustic noise cancellation (ANC). The first microphone 152 placed in the housing 102 acoustically couples to the ambient atmosphere, and the second microphone 154 in the acoustic passage 106 acoustically couples to the user's ear.

In some embodiments, the hearing device includes a wireless communication interface, e.g., Bluetooth, chip 158, which wirelessly couples the hearing device 100 to a remote device such as an audio gateway device. The hearing device may also include a near-field wireless interface, e.g., magnetic induction (NFMI), chip 160, which wirelessly couples the first hearable component 101 to a second hearable component. Furthermore, the electrical circuit 110 couples to the acoustic valve 108 so that the electrical circuit 110 can send valve control signals 161 to the acoustic valve 108 in order to change the state of the valve 108 between open and closed states.

FIG. 2 illustrates the hearing device 100 in which one or more context-ware sensors 200 and context determination logic circuit 202 are both located in the housing 102 of the hearing device 100. Although a plurality of sensors 200A through 200N are depicted in FIG. 2, any number of one or more sensors may be implemented into the hearing device 100 as appropriate. The sensors 200A through 200N send corresponding sensor data 204A and 204N, respectively, to the context determination logic circuit 202 which determines, based on the sensor data 204A and 204N, whether the acoustic valve 108 needs to be actuated. The context determination logic circuit 202 can be implemented as an integrated circuit or a processor coupled to memory such as RAM, DRAM, SRAM, flash memory, or the like, which stores the code executed by the context determination logic circuit 202, or other suitable configurations may be employed. When the context determination logic circuit 202 determines that the acoustic valve 108 needs to be actuated, valve control signal 206 is sent to valve driving circuit 208, which actuates the acoustic valve 108 by sending actuation signal 210 to the valve as instructed. The electrical circuit 110 includes the context determination logic circuit 202 and the valve driving circuit 208.

In FIG. 3, the hearing device 100 comprises a first hearable device 101 and a second hearable device 300, with the first hearable 101 coupled to an audio gateway device 302. Each of the hearables 101 and 300 can include hardware such as microphones, electro-acoustic transducers such as balanced armature receivers and/or dynamic speakers, valves with vent paths, Bluetooth transceiver and chip, and an NFMI chip, as appropriate. The audio gateway device 302 couples to the first hearable 101, either via a wired connection or wirelessly, such that the first hearable 101 receives audio data 304 from the audio gateway device 302. The audio data 304 can include telephone audio and telephone call status information such as incoming call, outgoing call, active status notification, and other information pertaining to the telephone call. The audio data 304 can also include music audio output data and valve command data, if such valve command is determined by the audio gateway instead of the hearables themselves.

The first hearable device 101 sends sensor and status data 306, which can include microphone signals from either or both of the hearables 101 and 300 as well as valve status information or other information indicative of the status such as the amount of internal impedance in the valve measured at a specific frequency, at 20 kilohertz, for example, to the audio gateway device 302. Also, the first hearable 101 sends control and audio signals 308, which can include a signal to actuate the acoustic valve in the second hearable 300 as well as audio output data for the electro-acoustic transducer in the second hearable 300. The second hearable 300 may send valve status or information indicative of the status, and sensor signals 310, which can include status information of the valve used in the second hearable 300 and any sensor signal such as microphone signal from the second hearable 300, to the first hearable 101. The data transfer between the hearables 101 and 300 can take place via a wired connection or wirelessly, as appropriate.

In one example, data transfer between the first hearable 101 and the audio gateway device 302 is done wirelessly, e.g., via Bluetooth connection. On the other hand, data transfer between the first hearable 101 and the second hearable 300 is done wirelessly using NFMI. However, other suitable forms of wireless communication may be employed. In this embodiment, only one of the hearables (in this example, the first hearable 101) is directly coupled to the audio gateway device 302 to send and receive signals between the hearable and the gateway, therefore the first hearable 101 is also referred to as a "master hearable" and the second hearable 300 a "slave hearable". Likewise, the audio gateway device 302 sends detected context data to the hearing device 100 independently of the sensors 202 in the hearing device 100, therefore the audio gateway device 302 can also be referred to as a "master device" and the hearing device 100 a "slave device". Alternatively, the gateway 302 may communicate directly with both hearable devices. Also, in the embodiment illustrated in FIGS. 1 to 3, the context determination logic circuit 202 is located in the hearing device 100. However, the context determination logic circuit 202 may be in the remote device such as the audio gateway device 302 in other embodiments.

Referring back to FIG. 1, the electrical circuit 110 is an integrated circuit, for example a processor coupled to memory such as random access memory (RAM) such as dynamic RAM (DRAM), static RAM (SRAM), and the like, or a driver circuit and includes logic circuitry to determine whether to actuate the acoustic valve 108 to change between open and closed states based on detected context data obtained from one or more sensors. Detected context includes different modes of operation and/or different use environment of the hearing device, the master device, or both, such that the detected contexts can at least roughly indicate where the user is and what the user is doing. A sensor is defined as any circuit or module capable of sensing and/or detecting such context, including the mode of operation of the hearing device which is also the mode of operation of the master device coupled to the hearing device. Different kinds of sensors detect different types of context of the hearing device and/or the master device. Various examples are discussed further herein.

In one embodiment, the sensor is one or more proximity sensors and the acoustic valve is actuated based on proximity detection. In FIGS. 1 and 3, the first proximity sensor 150 detects the proximity of a remote object, such as the user's hand, to the hearing device 100, and the second proximity sensor 151 detects the proximity of the hearing device 100 to the user's ear. The first proximity sensor 150 then sends a first proximity detection signal 162 to the electrical circuit 110 to notify of a change in the proximity of the remote object to the hearing device 100. Likewise, the second proximity sensor 151 sends a second proximity detection signal 163 to the electrical circuit 110 to notify of a change in the proximity of the hearing device 100 to the user's ear. The electrical circuit 110 actuates the acoustic valve based on the output signals of the proximity detectors 150 and 151.

For example, the acoustic valve may be opened in response to detecting that the housing is proximate the user's ear to reduce accumulation of pressure as the contact portion of the housing is inserted into inside the user's ear canal. The first proximity sensor on an exterior portion of the housing may be used to detect proximity of a user's hand as it reaches to remove the hearing device from the ear or actuation of the sensor by touch. After insertion of the hearing device into or in the user's ear, the acoustic valve may be configured in a default state, for example an open or closed state. The acoustic valve may be opened upon initiation of removal of the ear tip from the user's ear to avoid reducing pressure within the user's ear upon removal. A first proximity sensor may be used in conjunction with another sensor to activate the acoustic valve as appropriate. After the hearing device is inserted and upon detecting that the hearing device is operating in an audio content playback mode, for example, based on the context data from the audio gateway device, the acoustic valve may be closed to provide better listening performance.

In another embodiment, the sensor is a location sensor like GPS or other location determination device or algorithm. As suggested herein, such a sensor could be located in the hearing device or in a remote device that communicates with the hearing device. In this embodiment, the acoustic valve may be actuated based on a location of the hearing device or the remote device if the remote device moves in tandem with the hearing device. For example, the valve may be closed when the user is in a location like an industrial area where exposure to excessive noise is likely. The location sensor output may also be indicative of a change in location or motion. For example, the valve may be opened when the user is moving at a speed indicative of travel by vehicle so that the user can hear traffic. In some embodiments, the hearing device includes a manual actuation switch enabling the user to override an adaptive configuration of the valve state. For example, a passenger in a moving vehicle may prefer that the acoustic valve be closed to block environmental noise.

Figure 4:
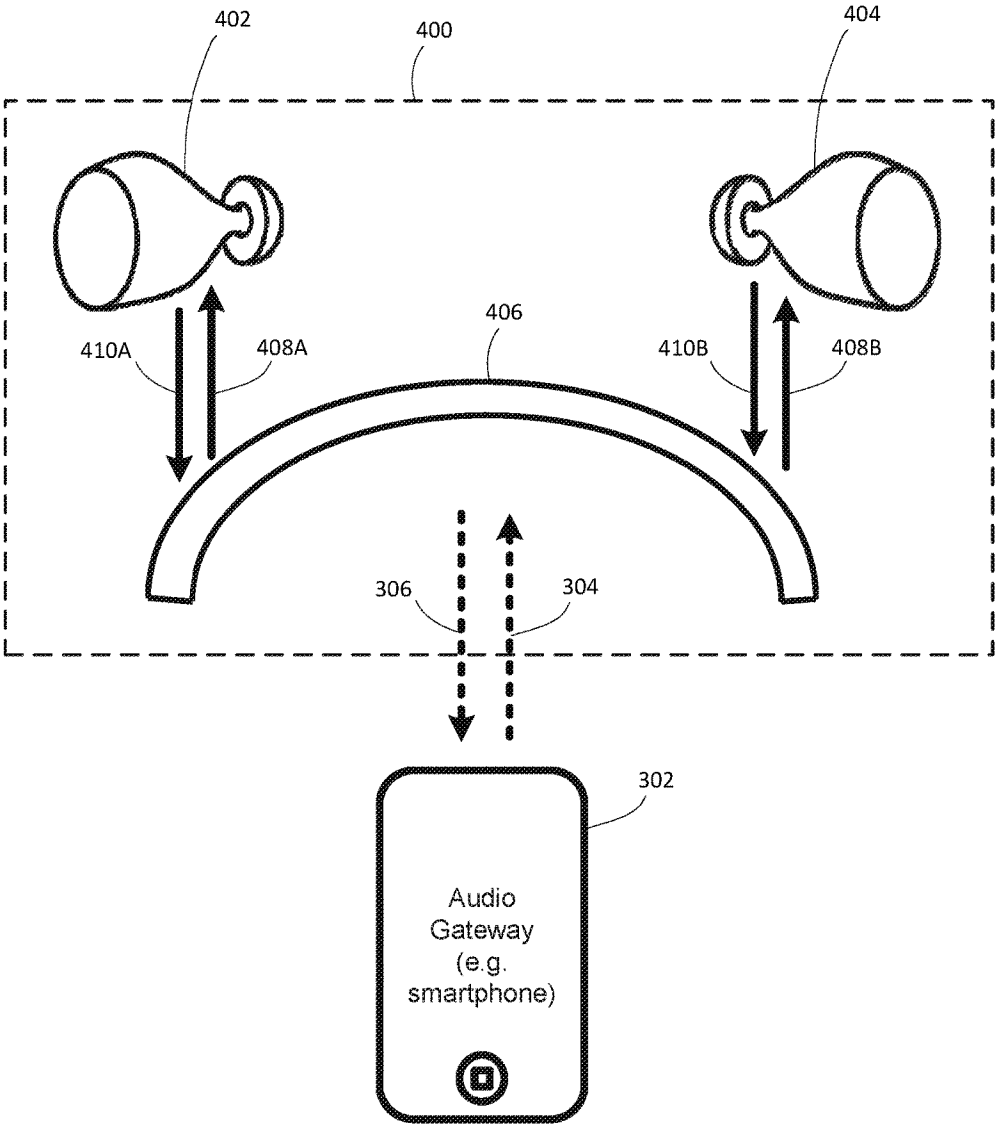
FIG. 4 is a schematic diagram illustrating the interactions between an audio gateway device, a master device, and a pair of hearing devices.

In another embodiment, the sensor is one or more microphones disposed on or in the housing of the hearing device and the acoustic valve is actuated based on sound sensed by the microphone. The acoustic valve may be opened or closed based on the type of sound detected. In one use case, the acoustic valve can be opened if speech is directed at or originating from the user. Speech originating from the user of the hearing device may be detected by a microphone disposed proximate the ear canal, for example the second microphone 154 in FIG. 1. External speech may be detected by the first microphone 152 in FIG. 1. Sounds sensed both by the microphones 152 and 154 may be used together to better differentiate the nature of the sound environment including, but not limited to, the voice of the user, speech directed at the user (directional detection), or other sounds indicative of context. An array of microphones on the hearing device may be used to determine whether speech is directed toward the user. Such an array may include microphones on first and second hearable devices and or microphones on a neck band 406 of the hearing device as shown in FIG. 4. The electrical circuit 110 determines whether the sound is noise or speech directed at or originating from the user of the hearing device. Audio processing algorithms capable of differentiating speech from noise and determining directionality are known and not described further herein.

In another microphone use case, the acoustic valve can be closed if ambient sound exceeds some threshold. Such a scenario may arise where the user is subject to a high decibel alarm, approaching siren or where background noise is at a level that may interfere with a voice call. In another use case, the acoustic valve is opened when the context is an ambient sound that the user should hear. Such sounds include sirens, car horns, and vehicles passing nearby, among others. Audio processing algorithms capable of identifying these and other types of sounds are known generally and not discussed further herein.

Another speech use case is voice commands or keywords voiced by the user to actuate the acoustic valve. The electrical circuit determines whether the sound detected by either of first and second microphones is a keyword preprogrammed for the hearing device 100, by the user, or as determined over time via machine learning or artificial intelligence such that, when the user says the keyword, the electrical circuit actuates the valve. Furthermore, an additional keyword may be determined by machine learning or artificial intelligence. For example, the user may set up the user's first name as the keyword for actuating the acoustic valve. Later, the electrical circuit or any suitable processor in the remote device, e.g. the audio gateway device, may employ machine learning to determine that the user manually opens the valve or removes the hearable every time the microphone detects the user's last name. As such, the electrical circuit or the processor in the remote device may then employ machine learning to decide to set the user's last name as the additional keyword so that each time the microphone detects the user's last name, the hearing device actuates the acoustic valve to the open state.

As noted above, using the first microphone 152 included in each of the hearables 101 and 300 of the hearing device 100 allows the electrical circuit 110 to determine a directionality of the sound detected by the first microphone 152. The electrical circuit 110 then uses the directionality to determine which hearable 101 or 300 needs acoustic valve actuation. For example, when the electrical circuit 110 determines the direction from which the ambient sound originates based on the ambient acoustic signals 164 from the two hearables 101 and 300, the electrical circuit 110 may determine to open only one of the two acoustic valves to allow the user to hear the ambient sound, in which the acoustic valve in the hearable closer to the origin of the ambient sound opens. Any suitable directionality algorithm may be used.

In another embodiment, the sensor is one or more inertial sensors disposed on or in the housing of the hearing device, and the acoustic valve is actuated based on acceleration detected by such sensors. In FIG. 1, the accelerometer 156 generates and sends detected acceleration signal 166 as the output signal to the electrical circuit 110. The electrical circuit 110 actuates the acoustic valve 108 in response to certain conditions. For example, the accelerometer 156 can be an inertial sensor that senses movement of the hearing device 100 and determines the acceleration. In one use case, the accelerometer 156 senses conditions (e.g., one or more thresholds) such as an impact that may have inadvertently changed the state of the acoustic valve 108. The logic can send a valve configuration signal when the acceleration exceeds a threshold level indicative of a possible inadvertent change in the state of the acoustic valve to ensure the valve is in the desired state. In this use case, it is not necessary to determine the state of the valve. It is only necessary to detect an impact that may inadvertently change the state of the valve.

An example of the acceleration that may cause an inadvertent state change is an acceleration that may be caused when the hearing device is dropped and impacts a surface. In one example, the acoustic valve may be in the closed state and the accelerometer may output a signal that is indicative of a high acceleration. A high acceleration may or may not have caused an inadvertent state change to the open state. In response to the acceleration, the electrical circuit may provide the valve with a pulse to put the valve in the closed state. If the valve was already in the closed state, then no state change will occur. If the valve did in fact change state due the acceleration, then the valve is put back in the closed state. Similarly, the electrical circuit may send a valve open pulse in response to detection of acceleration. An accelerometer is an example of the inertial sensor. Other types of inertial sensors, such as a gyroscope, may also be used to detect conditions that may cause inadvertent state change of the acoustic valve.

In another example, a first microphone, a second microphone, or both send signals indicative of a high acceleration. The microphone signal may respond to the acoustic environment caused by a drop of the hearable, for example. The microphone signal may also respond to vibrations and shock waves within the housing that are caused by a drop of the hearable, for example. Logic in the electrical circuit may use the input from the microphones to decide that a drop event or other event may have caused a high acceleration that could cause an inadvertent state change of the valve. The electrical circuit may then send the valve control signal to the valve to actuate the valve to the desired state.

In another use case, the inertial sensor generates a signal in response to physical activity of the user and the acoustic valve is actuated accordingly. For example, when the electrical circuit determines that the user is engaged in physical activity, such as running, the electrical circuit opens the acoustic valve in order for the user to hear ambient sounds, such as the sound of an approaching object, animal, person, or vehicle, to improve the user's safety during the physical activity. Opening the valve may also reduce the pressure fluctuations in the ear caused during physical activity when the device moves or bounces with respect to the ear of the user.

Outputs from other contextual sensors may also be used to actuate the valve. For example, a tactile or capacitive switch allows the user to change the state of the acoustic valve or the mode of operation of the hearing device. In one example, the electrical circuit may be programmed to recognize a single tap or multiple taps to the hearing device by the finger of the user, which can be detected by the capacitive switch or the first proximity sensor, for example, to change the mode of operation to actuate the acoustic valve to a different state. In another example, instead of a contextual sensor, the sensor can be used to directly actuate the valve. An infrared (IR) sensor can detect a motion of an object outside of the hearing device, which enables the user to wave a hand beside the hearing device 100 to change the state of the valve, for example, without the need to directly touch the hearing device. A positioning system may also be used to create or augment context determination. The positioning system may include satellite-based position system such as the global positioning system (GPS) or the global navigation satellite system (GLONASS), cellular tower signals, Wi-Fi signals, and other wireless positioning signals. The position tracker may also be implemented either in the hearing device or the audio gateway device to which the hearing device is coupled, so that when the electrical circuit detects that the user is in motion, e.g., above a threshold speed, the electrical circuit determines that the user is in a vehicle or driving a vehicle and opens the acoustic valve in order for the user to hear the ambient sounds.

The audio gateway device can be any suitable electronic device such as a smartphone, a tablet, a personal computer, automobile, or a television with Bluetooth capability; however, other suitable means of audio gateway may be employed. The electrical circuit actuates the acoustic valve based on the signal received via the Bluetooth chip, in which the signal indicates a change in the mode of operation for the hearing device or the gateway device.

For example, one mode of operation can be an audio content playback mode in which the electrical circuit receives audio signal from the audio gateway device wirelessly coupled to the hearing device using a wireless interface, and actuates the acoustic valve to the closed state. The other mode of operation can be a voice communication mode in which the electrical circuit actuates the acoustic valve to the open state to prevent occlusion during a voice call. The audio gateway device can implement a mobile application, also known as an "app", installed in the audio gateway device which utilizes a processor to execute software which detects when the mode of operation for the hearing device changes. The app senses a change in the mode of operation when the user accepts, initiates, or completes a voice call, content playback, etc. In this case the sensor is the application. The context determination circuit determines the desired state of the valve based on the mode of operation, and the electrical circuit actuates the acoustic valve accordingly. In another example, the app may have a user interface which allows the user to actuate the acoustic valve using the audio gateway device. Also, in another example, the operating system (OS) of the remote device detects and keeps track of any change in context of the remote device and the app uses the detected context data in determining whether the mode of operation for the hearing device, as well as the remote device, has changed.

In some embodiments, a plurality of detected context inputs as determined by the signals received from the sensors and other signal inputs are prioritized and the valve is actuated accordingly. In one embodiment, the electrical circuit may have access to a data table stored in the memory which indicates the priority of each type of detected contexts, such as a fire alarm being in a higher priority than listening to music. In one scenario, the valve remains in a closed state while the user sits in a room inside a building and listens to music from the audio gateway device. The first microphone senses a fire alarm originating from somewhere within the building, so that the electrical circuit opens the valve to alert the user of the fire alarm. As such, hearing the fire alarm or other similar ambient sounds takes priority over listening to the music. When the user exits the room and walks past the fire alarm, the electrical circuit detects the amplitude of 100 decibels (dB), which surpasses the sound pressure threshold. The electrical circuit then closes the valve to avoid damaging the user's hearing, which supersedes the ability to hear the fire alarm which, by this time, has achieved the purpose of warning the user of a potential fire in the building. In this case, the high amplitude 100 dB fire alarm may still be audible even with a closed valve when sealed in the user's ear, but the signal will be attenuated to achieve improved comfort and hearing protection for the user. Furthermore, the electrical circuit or the audio gateway device may contain program codes and algorithms to differentiate important alert sounds such as the fire alarm from other ambient sounds of lesser importance. In embodiments, that include a manual valve actuation input, the user's manual input may have priority.

The electrical circuit can also assign the higher priority to detected contexts associated with having the acoustic valve in the open state than to detected contexts associated with having the acoustic valve in the closed state. The electrical circuit actuates the acoustic valve based on the signal received from the sensors having the highest priority for the context. Also, the electrical circuit prioritizes a voice signal over a non-voice signal, so that the electrical circuit opens the acoustic valve in response to receiving the signal which indicates a voice. Furthermore, the electrical circuit prioritizes a signal which indicates a sound with a sound pressure above the sound pressure threshold, so that the electrical circuit closes the acoustic valve in response to receiving the signal which indicates the sound with the sound pressure above the sound pressure threshold.

FIG. 4 illustrates a hearing device 400 in which a first hearable 402 and a second hearable 404 are connected to a master device 406, which is coupled to the audio gateway device 302. Each of the hearables 402 and 404 is coupled, either via a wired connection or wirelessly, to a master device 406, which is for example a neckband which the user can wear around the neck when using the hearing device 400. The master device 406 is coupled to the audio gateway device 302, which may be via a wired connection or wirelessly, so that the audio gateway device 302 can send the audio data 304 to the master device 406, and the master device 406 can send the sensor and status data 306 to the audio gateway device 302. The hearing device 400 differs from the hearing device 100 in FIGS. 1 to 3 in that the hearables 402 and 404 of the hearing device 400 neither couples with each other nor with the audio gateway device 302, but instead couples to the master device 406. As such, both of the hearables 402 and 404 are "slave hearables" with respect to the master device 406.

The master device 406 sends first valve command and audio signal 408A to the first hearable 402 and second valve command and audio signal 408B to the second hearable 404. The valve command and audio signal 408 can include signal to actuate the acoustic valve in the corresponding hearable 402 or 404, as well as audio output data for the electro-acoustic transducer in the corresponding hearable 402 or 404. To the master device 406, the first hearable 402 sends first valve status and sensor signal 410A and the second hearable 404 sends second valve status and sensor signal 410B. The valve status and sensor signal 410 can include status information of the valve used in the corresponding hearable 402 or 404 and any sensor signal such as microphone signal from the corresponding hearable 402 or 404. The data transfer between the hearables 402 and 404 can take place via a wired connection or wirelessly, as appropriate.

Figure 5:
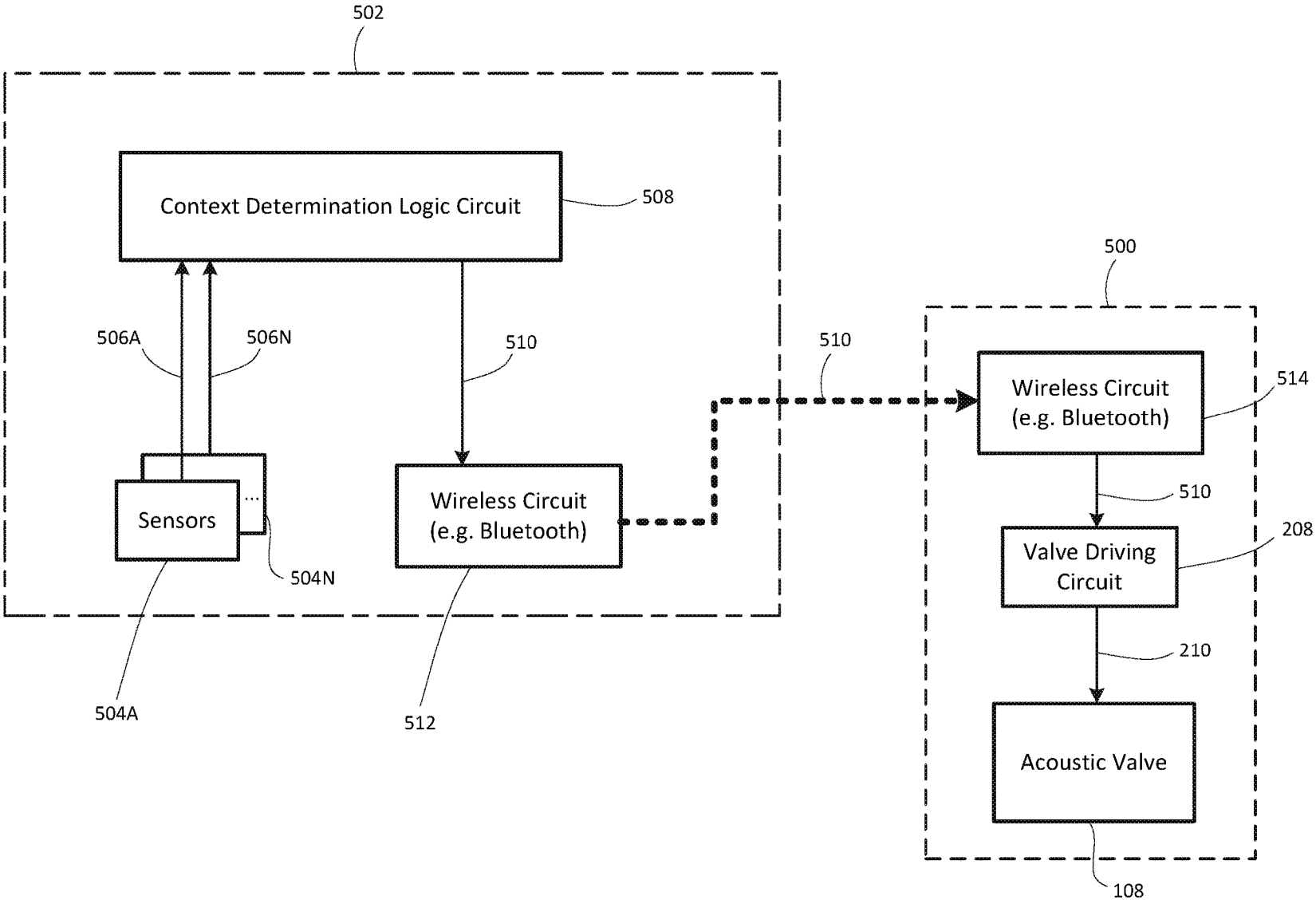
FIG. 5 is a block diagram illustrating a hearing device having the sensors and the context determination logic both located outside the hearing device, in the audio gateway device.

FIG. 5 illustrates a hearing device 500 coupled wirelessly via Bluetooth connection, for example, with an audio gateway device 502. The audio gateway device 502 includes a plurality of sensors 504A through 504N which send sensor data 506A through 506N, respectively, to context determination logic circuit 508. Based on the sensor data 506A through 506N, the context determination logic circuit 508 determines to actuate the acoustic valve 108 of the hearing device 500. The context determination logic circuit 508 then sends valve control signal 510 to wireless circuit 512, which may be for example a Bluetooth chip. The wireless circuit 512 of the audio gateway device 502 wirelessly transmits the valve control signal 510 to another similar wireless circuit 514 in the hearing device 500. Then, the wireless circuit 514 sends the valve control signal 510 to the valve driving circuit 208 coupled to the acoustic valve 108. The hearing device 500 differs from both the hearing device 100 in FIGS. 1 to 3 and the hearing device 400 in FIG. 4 in that the hearing device 500 do not contain any sensors that are used by the context determination logic. Instead, the sensors are implemented in a remote device, which in this case is the audio gateway device 502. As such, the hearing device 500 only receives the valve control signal 510 from the remote device and activates the valve driving circuit 208 accordingly, where the valve control signal 510 is based on context data detected by the remote device.

Figure 6:
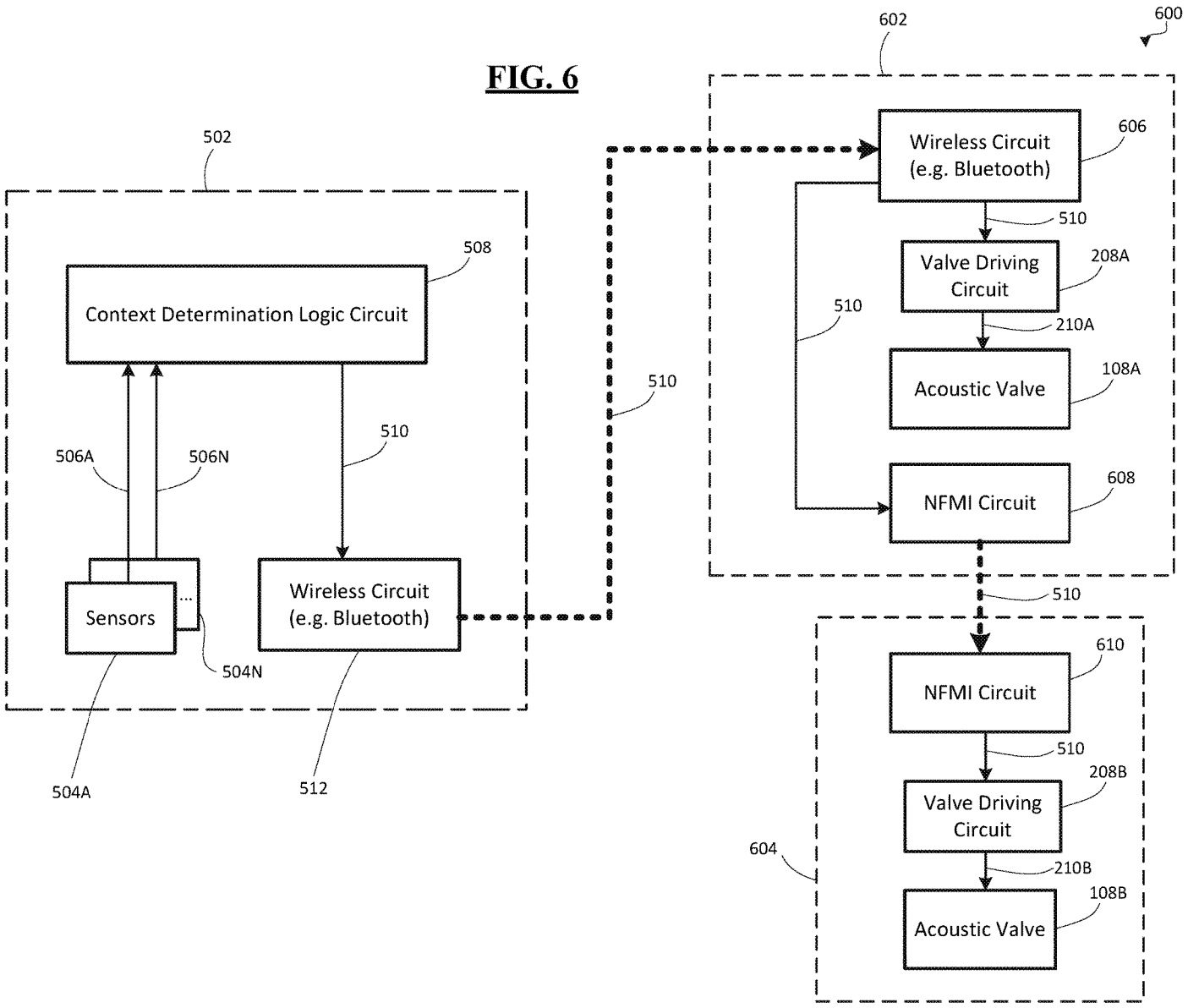
FIG. 6 is a block diagram illustrating a hearing device which includes two hearables, where the first hearable wirelessly receives data for the actuation of the acoustic valve from the audio gateway device and wirelessly sends the data to the second hearable.

FIG. 6 illustrates a hearing device 600 coupled wirelessly to the audio gateway device 502, the hearing device 600 having a first hearable 602 and a second hearable 604. Each of the hearables 602 and 604 includes an acoustic valve 108 (labeled as 108A and 108B in hearables 602 and 604, respectively). The context determination logic circuit 508, after determining that the acoustic valve 108 needs actuation, sends valve control signal 510 to the wireless circuit 512 of the audio gateway device 502 so that the wireless circuit 512 can transmit the valve control signal 510 to the wireless circuit 606 located in the first hearable 602. The wireless circuit 606 sends the valve control signal 510 to the valve driving circuit 208A after which the valve driving circuit 208A actuates the acoustic valve 108A using actuation signal 210A. The wireless circuit 606 also sends the valve control signal 510 to NFMI circuit 608 of the first hearable 602, so that the NFMI circuit 608 can then transmit the valve control signal 510 wirelessly to the NFMI circuit 610 of the second hearable 604. The NFMI circuit 610 then transfers the received valve control signal 510 to the valve driving circuit 208B which completes the actuation of the acoustic valve 108B of the second hearable 604 by sending actuation signal 210B to the valve 108B. The hearing device 600 differs from the hearing device 500 in FIG. 5 in that the first hearable 602, or the master hearable, receives the valve control signal 510 and transmits it to the second hearable 604, or the slave hearable.

Figure 7:
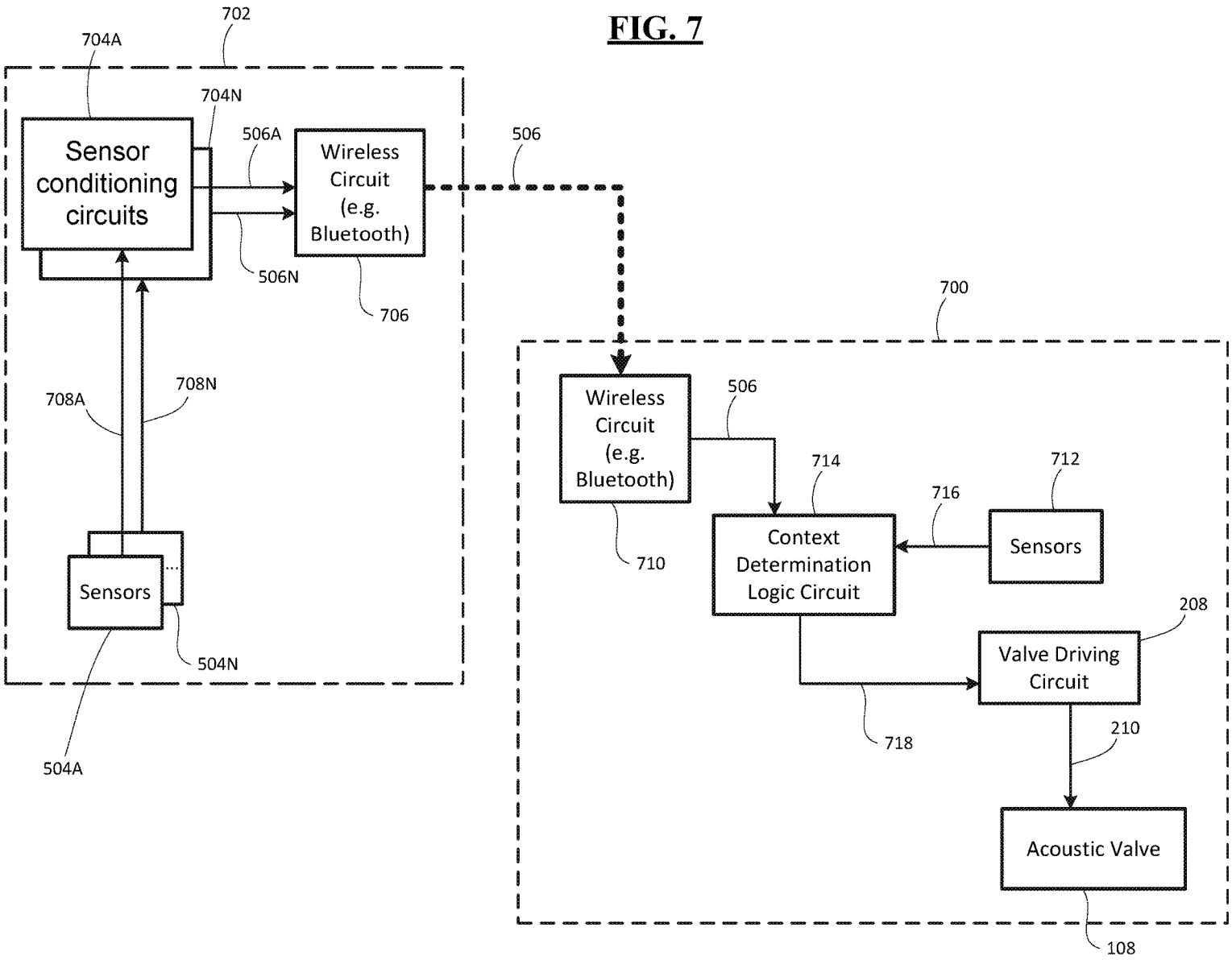
FIG. 7 is a block diagram illustrating a hearing device having the sensors located in both the audio gateway device and the hearing device, but the context determination logic is in the hearing device.

FIG. 7 illustrates a hearing device 700 wirelessly coupled to an audio gateway device 702 via, for example, Bluetooth connection. The audio gateway device 702 includes a plurality of sensors 504A through 504N, a plurality of sensor conditioning circuits 704A through 704N to condition the sensor signals, and wireless circuit 706. The sensors 504A through 504N send raw sensor data 708A through 708N to the corresponding sensor conditioning circuits 704A through 704N, after which the conditioning circuits 704A through 704N output the corresponding sensor data 506A through 506N to the wireless circuit 706 for transmission to the hearing device 700. The sensor conditioning circuits 704A through 704N process and selectively filter the raw sensor data 708 to send only the selected sensor data to the hearing device 700 in the form of the sensor data 506A through 506N which include, for example, any sensor data that surpass certain thresholds, such as the sound pressure threshold, thereby reducing the amount of raw sensor data 708 which the hearing device 700 needs to analyze when determining the actuation of the acoustic valve 108. The sensor conditioning circuits 702 also convert the data into a format suitable for transmission. The wireless circuit 706 transmits the sensor data 506A through 506N to another wireless circuit 710 of the hearing device 700, after which the receiving wireless circuit 710 sends the sensor data 506A through 506N to context determination logic circuit 714. The hearing device 700 also includes one or more sensors 712 that send sensor data 716 to the context determination logic circuit 714. After determining, based on the sensor data 506A through 506N from the audio gateway device 702 and the sensor data 716 from the hearing device 700, the context determination logic circuit 714 outputs valve control signal 718 to the valve driving circuit 208, which actuates the acoustic valve 108 using the actuation signal 210.

Figure 8:
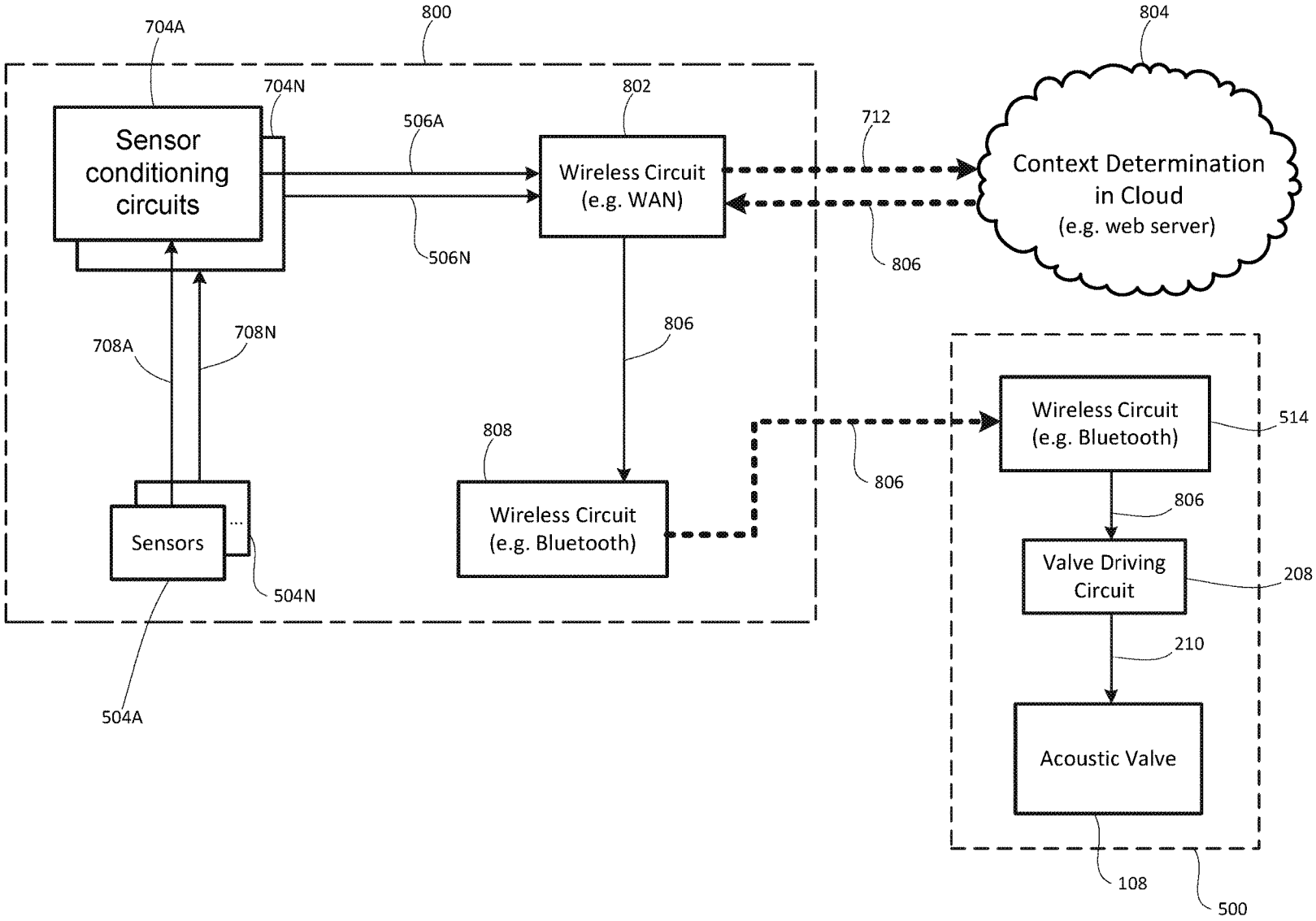
FIG. 8 is a block diagram illustrating a hearing device where the context determination is done in the cloud.

FIG. 8 illustrates the hearing device 500 coupled wirelessly via Bluetooth connection, for example, to an audio gateway device 800, with the audio gateway device 800 also wirelessly coupled via wide area network (WAN), for example, to virtual context determination processor 804 accessible via cloud network. The audio gateway device 800 includes wireless circuit 802 which receives the sensor data 506A through 506N from the plurality of sensor conditioning circuits 704. Instead of transmitting the sensor data 506A through 506N to the hearing device 500, the wireless circuit 802 transmits the sensor data 506A through 506N to the virtual context determination processor 804. The wireless circuit 802 can transmit the sensor data 506A through 506N wirelessly to the virtual context determination processor 804 in the cloud using WAN, although other suitable telecommunications networks and computer networks such as local area network (LAN) and enterprise network may be employed.

The virtual context determination processor 804 represents any suitable means of performing context determination in the cloud such as a web server accessed using an Internet Protocol (IP) network, including but not limited to services such as mobile backend as a service (MBaaS), software as a service (SaaS), and virtual machine (VM), which determines the need for actuating the acoustic valve 108 in the hearing device 500 and sends valve control signal 806 back to the wireless circuit 802. The wireless circuit 802 then transmits the valve control signal 806 to another wireless circuit 808 located in the audio gateway device 800. The wireless circuit 808 transmits the valve control signal 806 wirelessly via Bluetooth connection, for example, to the receiving wireless circuit 514 located in the hearing device 500, after which the valve driving circuit 208 receives the valve control signal 806.

Figure 9:
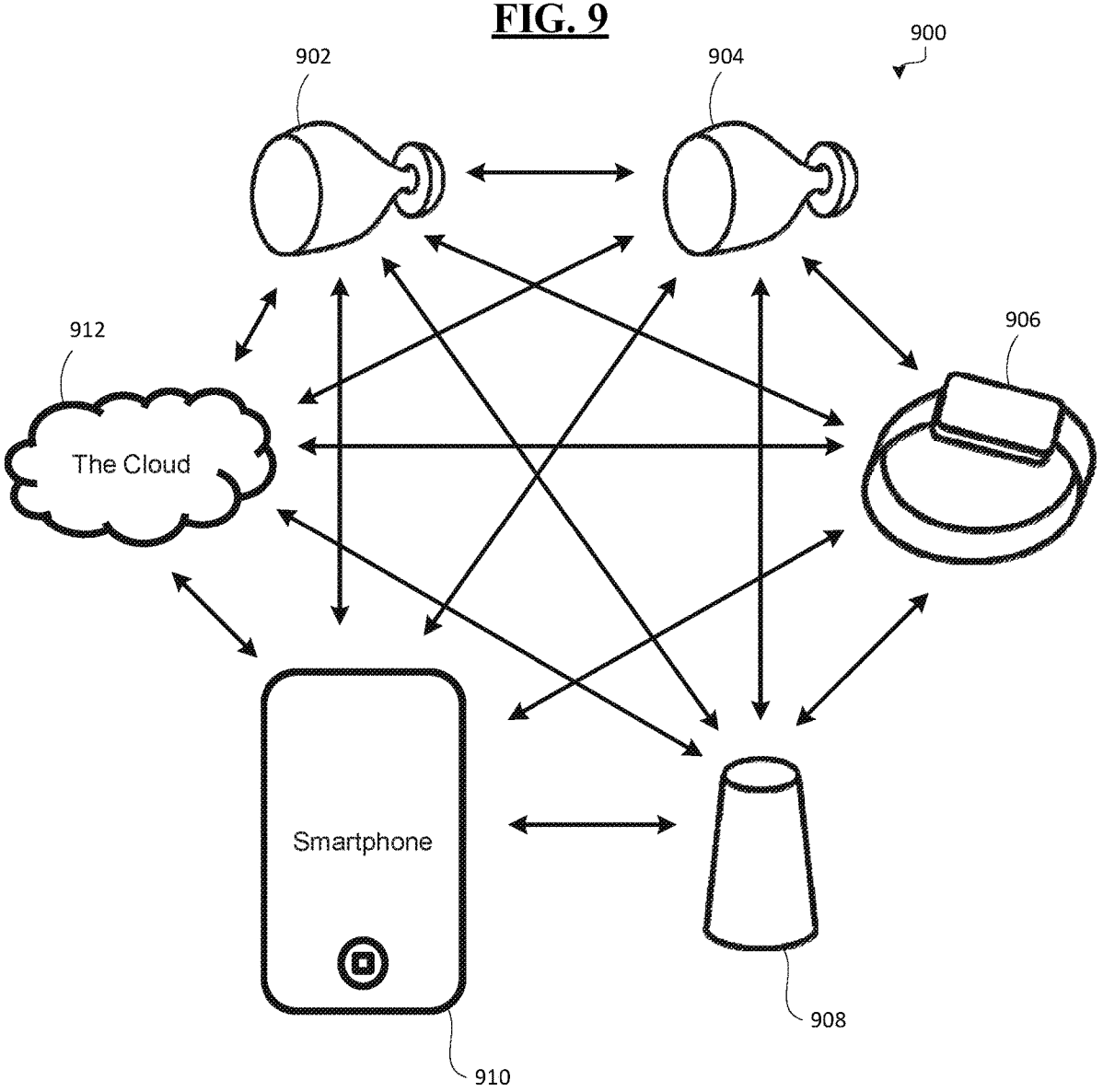
FIG. 9 is a schematic diagram illustrating a system including a hearing device, a cloud network, and one or more smart devices such as a smart wearable and a smartphone, all of which are interconnected to each other.

FIG. 9 illustrates a network 900 including a hearing device with two hearables 902 and 904, a smart wearable 906, a smartphone 910, other smart devices 908, and cloud network 912. Each of the smart devices (i.e. the smart wearable 906, the smartphone 910, and other smart devices 908) includes processors, user interfaces, memory, sensors, and wireless communication means. The processors may include, for example, a plurality of central processing units (CPUs) and graphic processing units (GPUs). The user interfaces may include graphical user interface (GUI), web-based user interface (WUI), and intelligent user interface (IUI). The memory may include random access memory (RAM), static RAM (SRAM), dynamic RAM (DRAM), and flash memory. The sensors may include microphones, GPS tracker, and touch-sensitive displays. The wireless communication means may include WAN, Bluetooth, and NFMI. Other suitable hardware and software may be implemented as appropriate. Each of the hearables 902 and 904 includes the valve 108 and the valve driving circuit 208 wired to the hearables, in addition to wireless circuits such as Bluetooth and/or NFMI chip to wirelessly couple with the other devices, and a Wi-Fi transceiver or any other suitable interface which enables the hearables 902 and 904 to access the cloud network 912. Each of the arrows in FIG. 9 represents raw detected context data such as sensor data, or processed data such as valve control signal data. The cloud network 912 may include a network server or a platform which connects to one or more processors via Internet or Intranet, as appropriate.

Each of the hearables 902 and 904, the smart wearable 906, the smartphone 910, and the other smart devices 908 may have the capability to convert sensor data into the processed data either in a low level or high level refinement. In the low level refinement, the device may filter the sensor data obtained from a microphone, for example, such that only the data representing a sound above the sound pressure threshold gets transmitted. In the high level refinement, the device may filter the sensor data using algorithm, for example, to interpret the sensor data as an activity, such as an accelerometer interpreting that the user is running based on the sensor data obtained. Each device may perform further refinement and ultimate decision-making, as appropriate. In one example, the hearable 902 may make the final decision based on the inputs from a variety of sources including the sensors of the hearable 902 itself.

While the present disclosure and what is presently considered to be the best mode thereof has been described in a manner that establishes possession by the inventors and that enables those of ordinary skill in the art to make and use the same, it will be understood and appreciated that in light of the description and drawings there are many equivalents to the exemplary embodiments disclosed herein and that myriad modifications and variations may be made thereto without departing from the scope and spirit of the disclosure, which is to be limited not by the exemplary embodiments but by the appended claimed subject matter and its equivalents.

What is claimed is:

1. A hearing device comprising:

a first housing having a first contact portion configured to form a substantially sealed coupling with a user's ear, the first housing having a first sound opening;

a sound-producing electro-acoustic first transducer disposed in the first housing, the first transducer configured to generate an acoustic signal in response to an electrical excitation signal applied thereto, wherein an acoustic signal generated by the first transducer emanates into the user's ear via the first sound opening when the first contact portion of the first housing is coupled to the user's ear;

a first acoustic valve disposed along a first acoustic passage of the first housing, the first acoustic valve actuatable to alter passage of sound through the first acoustic passage;

an electrical circuit configured to adaptively actuate the acoustic valve based on context detected by a sensor.

2. The device of claim 1 further comprising a wireless communication interface, wherein the electrical circuit is configured to actuate the first acoustic valve based on a signal received via the wireless communication interface, the signal indicative of the context detected by the sensor.

3. The device of claim 1, the context is a mode of operation of the hearing device, wherein the electrical circuit is configured to close the first acoustic valve when the hearing device is operated in a first mode of operation and the electrical circuit is configured to open the first acoustic valve when the hearing device is operated in a second mode of operation.

4. The device of claim 3, the first mode of operation is an audio content playback mode and the second mode of operation is a voice communication mode.

5. The device of claim 1, wherein the sensor has an output coupled to the electrical circuit, wherein the sensor generates an output signal in response to context and the electrical circuit is configured to actuate the first acoustic valve based on the output signal from the sensor.

6. The device of claim 5, the sensor is a microphone that generates the output signal in response to sound.

7. The device of claim 6, wherein the electrical circuit is configured to determine whether sound detected by the microphone is speech directed at or originating from a user of the hearing device and the electrical circuit is configured to open the first acoustic valve when speech is directed at or originating from a user of the hearing device.

8. The device of claim 6, wherein the electrical circuit is configured to determine whether sound detected by the microphone is a programmable keyword and the electrical circuit is configured to actuate the first acoustic valve based on the keyword.

9. The device of claim 6, the electrical circuit is configured to determine whether sound detected by the microphone exceeds a sound threshold and the electrical circuit is configured to close the first acoustic valve when the threshold is exceeded.

10. The device of claim 5 the sensor is a plurality of microphones disposed on the first housing.

11. The device of claim 5, the sensor includes a first microphone located on the first housing to detect ambient sound when the first contact portion of the first housing is coupled to the user's ear; and a second microphone located on the first housing to detect sound within the user's ear when the first contact portion of the first housing is coupled to the user's ear, wherein the electrical circuit is configured to actuate the first acoustic valve based on the output signal from the sensor.

12. The device of claim 5, the sensor is an inertial sensor that generates an output signal in response to detecting acceleration.

13. The device of claim 12, wherein the electrical circuit is configured to actuate the acoustic valve when acceleration exceeds a threshold indicative of a possible inadvertent change in a state of the acoustic valve.

14. The device of claim 12, wherein the electrical circuit is configured to actuate the acoustic valve when acceleration is indicative of physical activity of the user.

15. The device of claim 5, the sensor is a proximity detector configured to generate the output signal in response to detecting a change in proximity to a user's ear.

16. The device of claim 1, wherein the contact portion of the first housing is configured for insertion at least partially into a user's ear canal.

17. The device of claim 1, wherein the acoustic passage includes a first port acoustically coupled to a volume within the user's ear when the contact portion of the first housing is coupled to the user's ear, and the acoustic passage includes a second port coupled to ambient atmosphere when the contact portion of the first housing is coupled to the user's ear.

18. The device of claim 1 further comprising:

a second housing having a second contact portion configured to form a substantially sealed coupling with the user's other ear, the second housing having a second sound opening;

a sound-producing electro-acoustic second transducer disposed in the second housing, the second transducer configured to generate an acoustic signal in response to an electrical excitation signal applied thereto, wherein an acoustic signal generated by the second transducer emanates into the user's other ear via the second sound opening when the second contact portion of the second housing is coupled to the user's other ear;

a second acoustic valve disposed along a second acoustic passage of the second housing, the second acoustic valve actuatable to alter passage of sound through the second acoustic passage;

wherein the electrical circuit is configured to adaptively actuate the second acoustic valve based on context detected by a sensor.

19. The device of claim 18 further comprising a first microphone disposed on the first housing and a second microphone disposed on the second housing, the first microphone and the second microphone coupled to the electrical circuit, wherein the electrical circuit is configured to adaptively actuate the first acoustic valve and the second acoustic valve based on output signals from the first and second microphones.

20. The device of claim 19, wherein the electrical circuit is configured to determine a directionality of sound detected by the first and second microphones and the electrical circuit is configured to actuate the first and second valves based on directionality.

21. The device of claim 18, wherein the electrical circuit is configured to actuate the first acoustic valve in a first state and to actuate the second acoustic valve in a second state different than the first state, wherein the first acoustic valve is in the first state at the same time that the second acoustic valve is in the second state.

22. The device of claim 1, the context is a transition to a power ON state of the hearing device, wherein the electrical circuit is configured to actuate the first acoustic valve when the hearing device is transitioned to the power ON state.

* * * * *